US010465270B1

(12) United States Patent
Zhang et al.

(10) Patent No.: US 10,465,270 B1
(45) Date of Patent: Nov. 5, 2019

(54) CABLES HAVING CONDUCTIVE ELEMENTS FORMED FROM ALUMINUM ALLOYS PROCESSED WITH HIGH SHEAR DEFORMATION PROCESSES

(71) Applicants: Shenjia Zhang, Zionsville, IN (US); Cornelius A. Muojekwu, Indianapolis, IN (US); Nhon Q. Vo, Skokie, IL (US); Terry C. Lowe, Golden, CO (US)

(72) Inventors: Shenjia Zhang, Zionsville, IN (US); Cornelius A. Muojekwu, Indianapolis, IN (US); Nhon Q. Vo, Skokie, IL (US); Terry C. Lowe, Golden, CO (US)

(73) Assignees: General Cable Technologies Corporation, Highland Heights, KY (US); NanoAI LLC, Skokie, IL (US); Manhattan Scientifics, Inc., New York, NY (US)

( * ) Notice: Subject to any disclaimer, the term of this patent is extended or adjusted under 35 U.S.C. 154(b) by 0 days.

(21) Appl. No.: 15/883,203

(22) Filed: Jan. 30, 2018

Related U.S. Application Data

(60) Provisional application No. 62/452,138, filed on Jan. 30, 2017.

(51) Int. Cl.

| | |
|---|---|
| ***C22F 1/04*** | (2006.01) |
| ***C22C 21/00*** | (2006.01) |
| ***H01B 13/00*** | (2006.01) |
| ***H01B 1/02*** | (2006.01) |

(52) U.S. Cl.
CPC ..... *C22F 1/04* (2013.01); *H01B 1/023* (2013.01); *H01B 13/0036* (2013.01); *C22C 21/00* (2013.01)

(58) Field of Classification Search
CPC ..... C22F 1/04; H01B 1/023; H01B 13/0036; C22C 21/00
USPC ..... 174/126.1
See application file for complete search history.

(56) References Cited

U.S. PATENT DOCUMENTS

| | | | | |
|---|---|---|---|---|
| 2,162,938 | A * | 6/1939 | Comstock | B22F 9/08 149/37 |
| 6,895,795 | B1 * | 5/2005 | Chaudhury | B21C 23/00 72/253.1 |
| 7,152,448 | B2 * | 12/2006 | Zhu | B21C 23/005 72/262 |
| 8,999,079 | B2 * | 4/2015 | Kamat | C22C 21/10 148/417 |
| 9,147,504 | B2 * | 9/2015 | Kusakari | B21C 1/00 |
| 2006/0130549 | A1 * | 6/2006 | Zhu | B21C 23/005 72/262 |
| 2007/0151639 | A1 * | 7/2007 | Oruganti | B82Y 30/00 148/677 |
| 2010/0038112 | A1 * | 2/2010 | Grether | D07B 1/02 174/128.1 |
| 2010/0319820 | A1 * | 12/2010 | Koma | C22C 21/02 148/695 |

(Continued)

*Primary Examiner* — Andargie M Aychillhum
*Assistant Examiner* — Michael F McAllister
(74) *Attorney, Agent, or Firm* — Ulmer & Berne LLP

(57) ABSTRACT

A conductive element of a cable or a wire is formed of a high shear deformation processed aluminum alloy. The aluminum-zirconium alloy exhibits high electrical conductivity and high tensile strength. Methods of forming cables and wires are also further disclosed including the formation of all aluminum alloy cables having high ampacity.

13 Claims, 1 Drawing Sheet

(56) References Cited

U.S. PATENT DOCUMENTS

| | | | | |
|---|---|---|---|---|
| 2014/0000332 | A1* | 1/2014 | Wilson | B22F 3/20 72/253.1 |
| 2014/0041925 | A1* | 2/2014 | Davis | H01B 7/29 174/40 R |
| 2015/0213913 | A1* | 7/2015 | Yoshida | C22C 21/02 174/74 R |
| 2015/0213914 | A1* | 7/2015 | Sekiya | C22C 21/02 174/74 R |
| 2015/0279518 | A1* | 10/2015 | Comoret | C22C 21/00 174/70 A |
| 2016/0258042 | A1* | 9/2016 | Sanaty-Zadeh | C22C 21/00 |
| 2017/0110704 | A1* | 4/2017 | Siripurapu | B23K 35/40 |
| 2018/0114606 | A1* | 4/2018 | Ikeya | H01B 1/023 |

* cited by examiner

CABLES HAVING CONDUCTIVE ELEMENTS FORMED FROM ALUMINUM ALLOYS PROCESSED WITH HIGH SHEAR DEFORMATION PROCESSES

REFERENCE TO RELATED APPLICATIONS

The present application claims the priority benefit of U.S. provisional application Ser. No. 62/452,138, entitled CABLES HAVING CONDUCTIVE ELEMENTS FORMED FROM ALUMINUM ALLOYS PROCESSED WITH HEAT SHEAR DEFORMATION PROCESSES, filed Jan. 30, 2017, and hereby incorporates the same application herein by reference in its entirety.

TECHNICAL FIELD

The present disclosure generally relates to the construction of cables that include conductive elements formed from aluminum alloys processed with high shear deformation ("HSD") processes. The alloys exhibit high electrical conductivity and improved mechanical properties.

BACKGROUND

Conductive elements for cables can be selected based on the intended use of the cable in conjunction with the necessary electrical and mechanical properties required for the intended use. For example, it is known to use aluminum or aluminum alloys as the conductive element in cable applications as a consequence of aluminum's relatively low density and generally satisfactory electrical and mechanical properties. Improving the ampacity of cables formed from aluminum or aluminum alloy conductors has been difficult however. For example, aluminum alloys with high electrical conductivity, such as aluminum-zirconium alloys, exhibit relatively low tensile strength necessitating that cables formed from such aluminum-zirconium conductors be reinforced with additional support. Consequently, high ampacity aluminum-zirconium cables are typically formed as thermal-resistant aluminum conductor steel reinforced ("TACSR") cables or as aluminum-alumina conductor composite reinforced ("ACCR") cables. As can be appreciated, such cable constructions suffer from various issues such as galvanization between the aluminum and the steel as well as from high construction costs. It would be advantageous to provide improved aluminum alloys that can offer both high electrical conductivity and high tensile strength and which could obviate the need for additional support or reinforcement when used as the conductor of an overhead conductor.

SUMMARY

According to one embodiment, a cable includes one or more conductors. At least one of the one or more conductors is formed from a high shear deformation ("HSD") processed aluminum-zirconium alloy including about 0.1% or more, by weight, zirconium. The HSD processed aluminum-zirconium alloy exhibits a tensile strength of about 250 MPa or greater and an electrical conductivity of about 53% International Annealed Copper Standard ("IACS") or greater when measured at about 20° C.

According to another embodiment, a method of forming a cable includes casting an aluminum-zirconium alloy into a rod, feeding the rod through one or more high shear deformation processes, reducing the cross-section of the rod to form a first wire, and forming a cable with the first wire and one or more additional wires. The aluminum-zirconium alloy includes about 0.1% or more, by weight, zirconium.

DETAILED DESCRIPTION

Aluminum alloys exhibiting a combination of high electrical conductivity and high tensile strength can provide numerous benefits when used as conductive elements in cables and wires. For example, the use of such aluminum alloys can allow for the construction of self-supported cables which can have greater ampacity, or current carrying capacity, than conventional aluminum conductor cables formed without mechanical reinforcement. In certain embodiments, cables formed from the aluminum alloys described herein can have similar ampacity as TACSR and ACCR cables, having conductors formed from aluminum-zirconium alloys, but can be constructed similar to un-supported heat-resistant all-aluminum alloy conductor ("AAAC") cables. AAAC cables are formed exclusively of aluminum alloy and are free of insulation and jacket layers.

Generally, such cables can use improved aluminum alloys that can be formed by processing a suitable aluminum alloy with a high shear deformation ("HSD") process to form an HSD processed aluminum alloy. Sometimes alternatively referred to as severe plastic deformation ("SPD") processes, HSD processes can improve an aluminum alloy by refining and reducing the aluminum alloy's grain size to a sub-micron scale and by promoting the formation of uniformly dispersed nano-precipitates using high shear stresses. HSD processes can include high-pressure torsion ("HPT") processes, equal-channel angular pressing ("ECAP") processes, and accumulative roll bonding processes. Examples of certain HSD processes are disclosed in U.S. Pat. Nos. 5,904,062; 6,883,359; 7,152,448, 7,699,946; and U.S. Patent Application Pub. No. 2010/0269961, each incorporated herein by reference. HSD processes were not previously known for the improvement of cable conductors.

Figure 1:
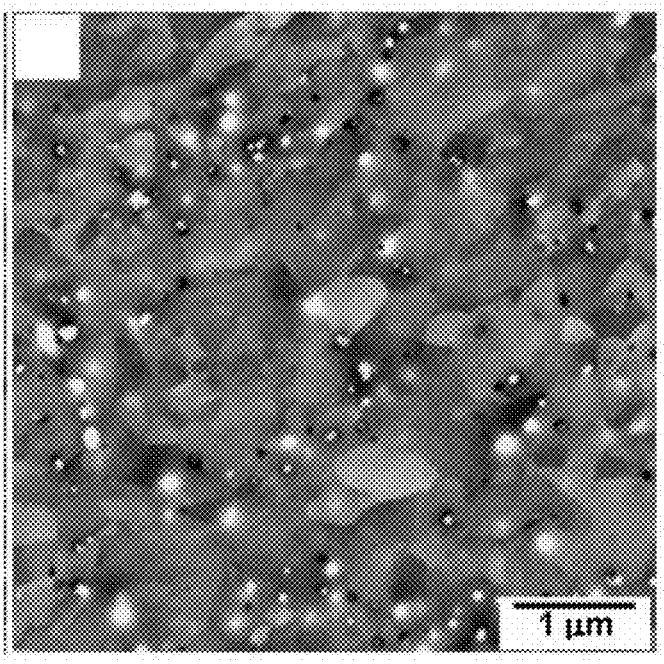
FIG. 1 depicts the backscatter image of an aluminum alloy after processing with an equal-channel angular pressing die.

High strains caused by HSD processes can substantially refine an aluminum alloys coarse grains into grains of about 1 micrometer or less in certain embodiments, about 500 nanometers or less in certain embodiments, about 200 nanometers or less in certain embodiments, and about 100 nanometers or less in certain embodiments. In certain embodiments, the grain size of an HSD processed aluminum alloy can be about 100 nm to about 200 nm in size. FIG. 1 depicts a backscatter image of an aluminum alloy processed with an ECAP die illustrating the sub-micron grain size of HSD processed aluminum alloys.

The ultrafine and nanoscale grain structures created by the HSD processes can allow the treated aluminum alloys to exhibit substantially higher tensile strength values. For example, the ultimate tensile strength of an aluminum-zirconium alloy can be increased by about 40% or more when measured in accordance to ASTM B941 after being treated with an HSD process as described herein. In certain embodiments, the ultimate tensile strength can be increased by about 45% or more, about 60% or more, about 75% or more, and about 100% or more as compared to a similar unprocessed aluminum-zirconium alloy. Unprocessed aluminum-zirconium alloys can have a tensile strength of about 160 MPa to about 250 MPa. In contrast, HSD processed aluminum-zirconium alloys can have a tensile strength of about 250 MPa to about 450 MPa in certain embodiments. As can be appreciated, such improvements can allow the HSD processed aluminum alloys described herein to exhibit the beneficial electrical conductivity of aluminum-zirconium alloys without suffering from the relatively weak tensile strength characteristic of traditional aluminum-zirconium alloys.

As can be appreciated, applying an HSD process to an aluminum alloy can also affect the distribution of solute atoms and solute nanostructures by influencing the precipitation and the segregation of solutes at grain boundaries and dislocations. HSD processes can influence these solutes and nanostructures through one or more of: the fragmentation of pre-existing precipitates due to the high strain of the HSD processes, by accelerating precipitation at high temperatures (e.g., at about 100° C. or more), by dissolving precipitates at low temperatures, and by changing the orientation of precipitates. The precipitates can also stabilize the dislocations formed by the HSD processes. The HSD processes can also beneficially result in a more uniform distribution of the nanoscale precipitates.

In certain embodiments, suitable HSD processes can modify the distribution of precipitates and grain sizes by varying one or more of the interstage process temperatures, the process speeds, and the magnitude of hydrostatic stress components in the high shear zone. Modification of such properties can vary the shear-enhanced precipitation kinetics and can allow for the formation of aluminum alloys which exhibit precisely tailored properties suitable for various intended uses. In certain embodiments, the modifications can be adjusted in real time as the aluminum alloy is being processed.

As can be appreciated, the ability of an HSD process to influence the precipitation kinetics can allow for the formation of unique HSD processed aluminum alloys. For example, precipitation kinetics can be controlled to increase the precipitation of zirconium from the solute phase of the aluminum alloy. Such precipitation can be advantageous because zirconium in the solute adversely affects the electrical conductivity of an alloy while the inclusion of zirconium in the alloy allows for increased creep resistance and tensile strength. The use of HSD processing to precipitate zirconium can allow for an aluminum alloy to include high levels of zirconium without detrimentally lowering the electrical conductivity of the HSD processed aluminum alloy. These benefits can allow HSD processed aluminum-zirconium alloys to have both higher electrical conductivity and tensile strength than similar unprocessed aluminum-zirconium alloys. In certain embodiments, the electrical conductivity of an HSD processed aluminum zirconium alloy can be greater than about 60% IACS while a similar, unprocessed, aluminum-zirconium alloy can be limited to about 60% or less IACS.

In certain embodiments, the HSD processed aluminum alloys described herein can be formed using an ECAP process. As can be appreciated, ECAP processes can produce significant strain on material by extruding the material through channels, or dies, that include tight corners (e.g., a right angle, or 90°, corner) while maintaining a constant cross-sectional area throughout the channel. Material can be extruded through an ECAP channel, or die, multiple times to impart additional strains to the material. In certain embodiments, material can be extruded through an ECAP channel one to six times.

Figure 2:
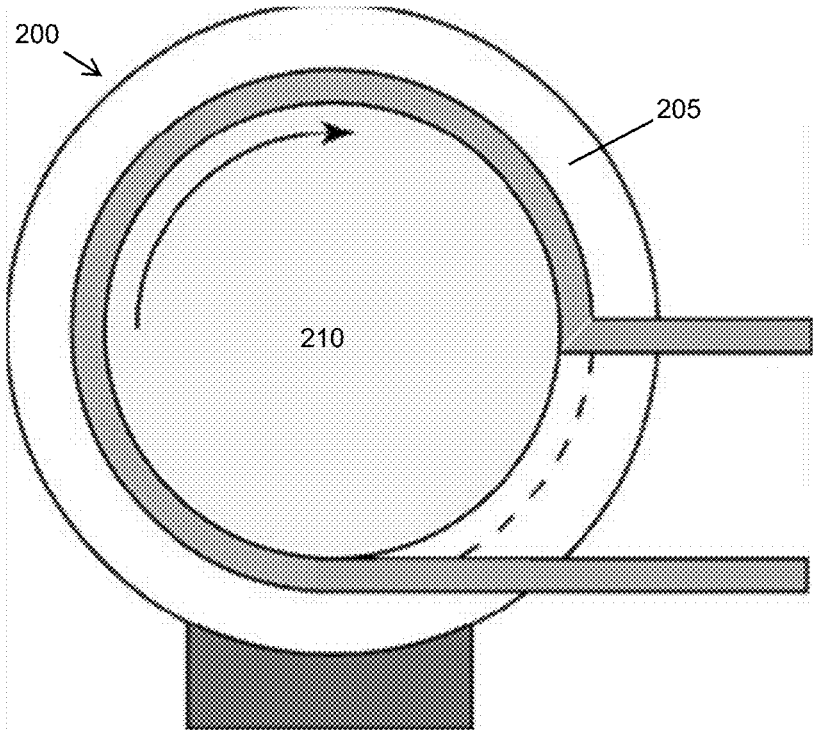
FIG. 2 depicts an example of an equal-channel angular pressing die according to one embodiment.

FIG. 2 depicts an example ECAP die 200 which includes a fixed outer die channel 205, a circular moving inner die part 210, and a channel formed between the fixed outer die channel and the circular moving inner die part (depicted with material in the channel). The channel includes both a sharp turn and a right angle corner. As can be appreciated, certain ECAP dies, such as the die depicted in FIG. 2, can be operated with a continuous flow of material. Movement of material through the die is facilitated by the circular moving inner die part 210.

As can be appreciated, a variety of aluminum alloys can be suitable for processing with the HSD processes described herein to form the HSD processed aluminum alloys. Particularly suitable aluminum alloys can include aluminum-zirconium alloys which already exhibit beneficial qualities such as excellent electrical conductivity, creep resistance, heat aging resistance, and softening resistance prior to HSD treatment. For example, particularly suitable aluminum-zirconium alloys can exhibit an electrical conductivity of about 53% International Annealed Copper Standard ("IACS") or greater when measured at 20° C., about 55% IACS or greater, about 58% IACS or greater, about 60% IACS or greater, and about 63% IACS or greater in various embodiments. Processing of the aluminum alloy with an HSD process can have a minimal effect on the electrical conductivity of the alloy and HSD processed aluminum alloys can have an electrical conductivity of 53% IACS or greater, about 55% IACS or greater, about 58% IACS or greater, about 60% IACS or greater, and about 63% IACS or greater in various embodiments.

The inclusion of nanoscale aluminum-zirconium precipitates in suitable alloys can also improve the creep performance of the HSD processed aluminum alloys as compared to similar aluminum alloys without the nanoscale precipitates. As can be appreciated, improved creep performance can facilitate the use of the HSD processed alloys in applications that were previously difficult for pure aluminum or known aluminum alloys to be utilized in.

An HSD processed aluminum alloy as described herein can also exhibit improved resistance to stress relaxation resistance. As can be appreciated, stress relaxation is one of the most important concerns in the design of electrical contacts and is defined as the decrease in stress when subject to a constant strain. A conductive element (e.g., wire) formed of an HSD processed aluminum alloy can exhibit a longer stress relaxation time than a similar aluminum-zirconium alloy that is not processed with an HSD process when measured in accordance to ASTM E328 standards. As can be appreciated, improved resistance to stress relaxation can allow for stronger cables that resist deformation or improved electrical connectors.

In addition to improved stress relaxation resistances, an HSD processed aluminum alloy as described herein can also exhibit a higher yield stress than a comparative 8000 series aluminum alloy as described by, for example, ASTM Specification B800 and having chemical formula $AlFe_{0.430\%}Zn_{0.020\%}Si_{0.40\%}$. As can be appreciated, such improvements to the yield strength and stress relaxation time can allow for the described HSD processed aluminum alloys to better withstand higher crimping or terminating forces.

Aluminum alloys having a high softening resistance temperature are also useful for the described HSD processes. Suitable aluminum-zirconium alloys can have a softening resistance temperature of about 150° C. to about 450° C., or any integer value in between about 150° C. to about 450° C., such as about 150° C. to about 230° C., when measured in accordance to IEC 62004. As can be appreciated, such aluminum-zirconium alloys can operate at higher temperatures than comparative aluminum alloys having lower softening resistance temperatures. For example, HSD processed aluminum-zirconium alloys can have a continuous operating temperature, when operated as a conductor, of about 70° C. or greater, about 90° C. or greater, about 100° C. or greater, about 150° C. or greater, or about 200° C. Comparative aluminum alloys, such as AA1350 and 6201-T81 aluminum alloys, can have a continuous operating temperature of only about 90° C.

Suitable aluminum alloys that can be processed into the HSD processed aluminum alloys described herein can be formed predominantly of aluminum (e.g., about 99%, by weight, or more aluminum). For example, suitable aluminum alloys for treatment with the described HSD processes can be aluminum-zirconium alloys. In certain embodiments, suitable aluminum-zirconium alloys can include about 0.2% to about 0.5%, by weight, zirconium, about 0.1% to about 0.5%, by weight iron, and aluminum as balance. Additional examples of suitable aluminum alloys for the described HSD processes can include any 8040-type aluminum-zirconium alloys as well as any of the aluminum-zirconium alloys described in U.S. Pat. No. 9,453,272 and U.S. application Ser. No. 15/294,273 each incorporated herein by reference. For example, in certain embodiments, suitable aluminum-zirconium alloys can be $Al_{99\%}Fe_{(0.4\text{-}0.5)\%}Zr_{(0.25\text{-}0.3)\%}Sn_{(0.05\text{-}0.1)\%}$. As can be appreciated, such alloys can additionally include small quantities of additional elements such as copper, manganese, silicon, and zinc.

In certain embodiments, artificial aging processes can be employed to promote the formation of nanoscale precipitates. In an artificial aging process, elevated temperatures are used to promote the formation of nanoscale precipitates from the aluminum alloy.

In certain embodiments, suitable aluminum-zirconium alloys can also optionally include an inoculant such as tin to enhance precipitation kinetics and reduce the time, and/or temperature, required for any artificial aging processes. In such embodiments, the inclusion of the inoculant can facilitate the formation of nanoscale aluminum-zirconium precipitates at lower temperature and with shorter artificial aging processes than similar aluminum alloys formed without the inoculant. For example, the inclusion of an inoculant can reduce the artificial aging time to about 2 hours, or less, in certain embodiments. The artificial aging temperature of an aluminum-zirconium alloy including an inoculant can be about 450° C., or less, in certain embodiments. An inoculant can also reduce the size of the nanoscale precipitates.

As can be appreciated however, operating the ECAP processes at elevated temperatures can also induce rapid nanoscale precipitation advantageously reducing the need for, or the quantity of, an inoculant. In such embodiments, the ECAP process can be operated at elevated temperatures of about 150° C. to about 450° C., about 200° C. to about 400° C., or about 250° C. to about 350° C. Reducing the quantity of an inoculant can be advantageous because the inclusion of an inoculant can detrimentally affect the castability of an aluminum alloy. In certain embodiments, an inoculant can be included at about 0.3%, by weight of the alloy, or less, at about 0.2%, by weight of the alloy, or less, at about 0.1%, by weight of the alloy, or less, and at about 0.05%, by weight of the alloy, or less. In certain embodiments, a suitable aluminum alloy can also be substantially free of an inoculant. As used herein, the term "substantially free of" means that the component is not specifically included in the aluminum alloy and if present, is found only in incidental amounts.

By inducing nanoscale precipitation, elevated temperature ECAP processes can reduce, or eliminate, the need to include an artificial aging process for the HSD processed aluminum alloys. As can be appreciated however, elevated temperature ECAP processes can have a detrimental effect on the grain reduction benefits of the ECAP processes. In certain embodiments, multi-stage ECAP processes with non-isothermal shear-induced chemical mixing can be used to balance nanoscale precipitation and grain reduction by promoting desirable precipitation sequences while maintaining suitable grain refinements. For example, multi-stage ECAP processes can use a combination of high temperature ECAP passes to promote nanoscale precipitation and lower temperature ECAP passes to promote the formation of nanoscale grain structures. In certain embodiments, artificial aging processes can be reduced or entirely eliminated.

According to certain embodiments, examples of suitable inoculants can include any metal or metalloid that lowers the activation energy required for diffusion in an α-Al matrix as compared to the activation energy required for diffusion in an α-Al matrix free of an inoculant. Non-limiting examples of such inoculants can include Group 3A, Group 4A and Group 5A metals and metalloids as well as zinc. For example, suitable inoculants that can increase the kinetics of zirconium diffusion in an α-Al matrix can include tin, indium, antimony, magnesium, zinc, gallium, germanium, and, in combination with other inoculants, silicon, in certain embodiments. In certain embodiments including an inoculant, the inoculant can be tin.

As can be appreciated, the selection and order of processing steps, including HSD processes, can affect the performance of an HSD processed aluminum alloy. For example, use of a heat treatment step and the sequencing of such a step, can influence the precipitation kinetics of an aluminum alloy. In certain embodiments, controlled process temperature during an HSD processing step can eliminate, or reduce the time of, any heat treatment steps.

According to certain embodiments, an HSD cable or wire can be formed by (1) casting and forming an aluminum alloy into a bar or rod; (2) feeding the bar or rod through one or more high shear deformation processes at a controlled temperature to control grain refinement, recrystallization, and precipitation of alloy elements; (3) reducing the cross-section of the bar or rod by rolling and/or wire drawing to form a wire; and (4) heat treating the wire at about 250° C. to about 500° C. to complete precipitation of the alloy elements. As can be appreciated, the high shear deformation processes can decrease or maintain the cross-sectional area of the bar or rod.

According to certain alternative embodiments, an HSD cable or wire can be formed by (1) casting and forming an aluminum alloy into a bar or rod; (2) annealing the bar or rod at 450° C. to about 650° C. to dissolve the alloy elements into solution; (3) feeding the bar or rod through one or more high shear deformation processes at a controlled temperature to control grain refinement, recrystallization, and precipitation of alloy elements; (4) reducing the cross-section of the bar or rod by rolling and/or wire drawing to form a wire; and (5) heat treating the wire at about 250° C. to about 500° C. to complete precipitation of the alloy elements.

In other certain embodiments, an HSD cable or wire can be formed by (1) casting and forming an aluminum alloy into a bar or rod; (2) feeding the bar or rod through one or more high shear deformation processes at a controlled temperature to control grain refinement, recrystallization, and precipitation of alloy elements; (3) heat treating the rod or bar at about 250° C. to about 500° C. to complete precipitation of the alloy elements; and reducing the cross-section of the bar or rod by rolling and/or wire drawing to form a wire.

As can be appreciated, the high shear deformation processes described herein can decrease or maintain the net cross-sectional area of a bar or rod being processed.

Cables including conductive elements formed from the HSD processed aluminum-zirconium alloys described herein can be used in a variety of applications including, for example, overhead cable applications, building wire applications, automotive applications, aerospace applications, power transmission applications, household cabling applications, and any other application requiring a lightweight cable which does not need to be reinforced with additional support. Conductive elements formed from an HSD processed aluminum alloy as disclosed herein can be used in wires as small as about 1 μm in diameter in certain embodiments or as large as about 25.4 mm (1") inch diameter, or larger, in certain embodiments. For example, aluminum bond wires as small as about 18 μm (0.7 mils) in diameter can be formed in certain embodiments and wire as large as about 4/0 (11.68 mm or 0.46") inch diameter can be formed in certain embodiments.

Generally, the present aluminum-zirconium alloy conductive wires or elements can be utilized similarly to conductive wires or elements produced from known aluminum alloys such as heat resistant aluminum-zirconium alloys and 8000 series aluminum alloys. Certain conventional examples of heat resistant aluminum-zirconium alloys are described in the specification for the ASTM B941 testing protocol and can have, for example, the chemical formula $AlZr_{0.287\%}Fe_{0.206\%}Si_{0.045\%}$. As will be appreciated however, the combination of high electrical conductivity and tensile strength of the HSD processed aluminum alloys described herein can allow for cables with substantially improved mechanical performance or can eliminate the need for mechanical reinforcement.

Cables including conductive elements formed of the improved aluminum-zirconium alloys described herein can generally be constructed using known techniques and cable geometries by replacing the existing conductive elements with the conductive element formed from the HSD processed aluminum alloys. Known wire processing techniques such as wire drawing can be used to form the conductive elements of a cable. For example, simple power cables can be formed by stranding the HSD processed aluminum alloys and then coating the conductive elements with an insulation layer and/or jacket layer. Any known insulation layer or jacket layer can be utilized as known in the art.

Although the HSD processed aluminum alloys can be used to form AAAC overhead cables with no reinforcement, the HSD processed aluminum alloys can alternatively be reinforced to form aluminum conductor steel reinforced ("ACSR") cables, aluminum conductor steel supported ("ACSS") cables, and aluminum conductor composite core ("ACCC") cables. ACSR cables are high-strength stranded conductors and include outer conductive strands, and supportive center strands. The outer conductive strands can be formed from the HSD processed aluminum-zirconium alloys described herein. The center supportive strands can be steel and can have the strength required to support the more ductile outer conductive strands. ACSR cables can have an overall high tensile strength. ACSS cables are concentric-lay-stranded cables and include a central core of steel around which is stranded one, or more, layers of the improved aluminum-zirconium alloy wires. ACCC cables, in contrast, are reinforced by a central core formed from one, or more, of carbon, glass fiber, or polymer materials. A composite core can offer a variety of advantages over an all-aluminum or steel-reinforced conventional cable as the composite core's combination of high tensile strength and low thermal sag enables longer spans. ACCC cables can enable new lines to be built with fewer supporting structures. AAAC cables can be made with the HSD processed aluminum alloy wires. ACSR, ACSS, and ACCC cables can be used as overhead cables for overhead distribution and transmission lines. The use of the HSD processed aluminum alloys in such cable geometries can allow for the construction of cables with larger aluminum conductor cross-sections.

Composite core conductors are useful due to having lower sag at higher operating temperatures and their higher strength to weight ratio. Non-limiting examples of composite cores can be found in U.S. Pat. Nos. 7,015,395, 7,438,971, 7,752,754, U.S. Patent App. No. 2012/0186851, U.S. Pat. Nos. 8,371,028, 7,683,262, and U.S. Patent App. No. 2012/0261158, each of which are incorporated herein by reference.

Examples

Table 1 depicts a comparison between the expected properties of an HSD processed aluminum alloy with multiple temperature controlled passes as described herein and 6201-T81 aluminum alloy. 6201-T81 aluminum alloy is used as the conductor for conventional all aluminum alloy conductor ("AAAC") cables.

TABLE 1

| Aluminum Alloy | Tensile Strength (MPa) | Electrical Conductivity (% IACS at 20° C.) | Continuous Operating Temperature (° C.) |
|---|---|---|---|
| 6201-T81 | 317 minimum | 51.6 minimum | 90 |
| Aluminum-Zirconium processed with high shear deformation | About 250 to about 450 | about 56 to about 58 | 200 |

As depicted by Table 1, an HSD processed aluminum alloy described herein is expected to exhibit greater tensile strength, electrical conductivity, and continuous operating temperatures than the 6201-T81 aluminum alloy that AAAC cables were previously constructed with. As can be appreciated, the higher tensile strength values can mean that AAAC cables formed from the disclosed HSD processed aluminum alloys can have greater mechanical robustness, and can enable the replacement of heavy steel reinforced cables with lightweight AAAC cables. Additionally, such higher tensile strength values can allow for overhead conductor cables to have larger spacing between support towers and can allow for improved reliability under severe weather conditions such as high winds and ice accumulation conditions.

The higher electrical conductivity and continuous operating temperatures of the HSD processed aluminum alloys can also mean that a cable can be rated for a higher ampacity for a fixed cross-sectional area than a similar cable formed from the 6201-T81 comparative alloy. As can be appreciated, this improvement can allow for overhead conductors to operate at increased ampacities or to operate with smaller diameter conductors. Replacement of existing AAAC cables with AAAC cables formed of the aluminum-zirconium alloy processed with ECAP can reduce transmission losses by about 13% and can substantially increase the ampacity of the overhead conductor distribution lines.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross-referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests, or discloses any such invention. Further, to the extent that any meaning or definition of a term in this document conflicts with any meaning or definition of the same term in a document incorporated by reference, the meaning or definition assigned to that term in the document shall govern.

The foregoing description of embodiments and examples has been presented for purposes of description. It is not intended to be exhaustive or limiting to the forms described. Numerous modifications are possible in light of the above teachings. Some of those modifications have been discussed and others will be understood by those skilled in the art. The embodiments were chosen and described for illustration of ordinary skill in the art. Rather it is hereby intended the scope be defined by the claims appended various embodiments. The scope is, of course, not limited to the examples or embodiments set forth herein, but can be employed in any number of applications and equivalent articles by those of hereto.

What is claimed is:

1. A cable comprising one or more conductors, wherein at least one of the one or more conductors is formed from a high shear deformation ("HSD") processed aluminum-zirconium alloy, wherein the HSD processed aluminum-zirconium alloy comprises about 0.1% or more, by weight, zirconium and exhibits:

an ultimate tensile strength of about 250 MPa or greater; and an electrical conductivity of about 53% International Annealed Copper Standard ("IACS") or greater when measured at 20° C.

2. The cable of claim 1 is an overhead conductor.

3. The cable of claim 2, wherein the overhead conductor is an all-aluminum alloy conductor.

4. The cable of claim 1, wherein the HSD processed aluminum-zirconium alloy further comprises an inoculant.

5. The cable of claim 4, wherein the inoculant comprises tin.

6. The cable of claim 1 continuously operates at a temperature of about 70° C. or more.

7. The cable of claim 1, wherein the HSD processed aluminum-zirconium alloy is formed using one or more of a severe plastic deformation process, an equal-channel angular pressing ("ECAP") process, an equal channel angular extrusion process, and a continuous extrusion process.

8. The cable of claim 1, wherein the HSD processed aluminum-zirconium alloy has a grain size of about 1 micron or less.

9. The cable of claim 1, wherein the HSD processed aluminum-zirconium alloy has a grain size of about 100 nanometers to about 200 nanometers.

10. The cable of claim 1, wherein the HSD processed aluminum-zirconium alloy exhibits an ultimate tensile strength of about 40% to about 100% greater than the ultimate tensile strength of a similar aluminum alloy processed without high shear deformation.

11. The cable of claim 1, wherein the HSD processed aluminum-zirconium alloy exhibits an ultimate tensile strength of about 400 MPa or greater.

12. The cable of claim 1, wherein the HSD processed aluminum-zirconium alloy has a softening temperature of about 150° C. to about 450° C.

13. The cable of claim 1, wherein the HSD processed aluminum-zirconium alloy is $Al_{99\%}Fe_{(0.4\text{-}0.5)\%}Zr_{(0.25\text{-}0.3)\%}Sn_{(0.05\text{-}0.1)\%}$.

* * * * *